US010640901B1

(12) United States Patent
Chen

(10) Patent No.: US 10,640,901 B1
(45) Date of Patent: May 5, 2020

(54) PORTABLE SEWING TOOL KIT

(71) Applicant: Chi-Jen Chen, Xihu Township, Changhua County (TW)

(72) Inventor: Chi-Jen Chen, Xihu Township, Changhua County (TW)

( * ) Notice: Subject to any disclaimer, the term of this patent is extended or adjusted under 35 U.S.C. 154(b) by 0 days.

(21) Appl. No.: 16/246,927

(22) Filed: Jan. 14, 2019

(51) Int. Cl.
*D05B 91/00* (2006.01)
*D06F 83/00* (2006.01)

(52) U.S. Cl.
CPC ..... *D05B 91/00* (2013.01); *D06F 83/00* (2013.01); *D05D 2305/08* (2013.01)

(58) Field of Classification Search
CPC .. A45C 1/00; A45C 1/06; A45C 11/00; A45C 11/24; B65D 21/08; B65D 21/086; B65D 85/24; D05B 91/00; D05D 2305/08; D06F 83/00
USPC ..... 206/37, 38, 38.1, 349–373, 574
See application file for complete search history.

(56) References Cited

U.S. PATENT DOCUMENTS 2,658,544 A * 11/1953 Osaka ..... A45C 11/24 206/38
2,681,092 A * 6/1954 Davis ..... A45C 11/24 150/143
2,771,187 A * 11/1956 Haile ..... B65D 85/24 206/380
3,301,295 A * 1/1967 Fitch ..... A45C 1/06 190/100
2017/0166355 A1* 6/2017 Zaremski ..... D05B 91/00

* cited by examiner

*Primary Examiner* — Bryon P Gehman
(74) *Attorney, Agent, or Firm* — Egbert Law Offices, PLLC

(57) ABSTRACT

A portable sewing tool kit, wherein the main features include: a substrate with an inner face and a back face, wherein the inner face is provided with first and second pages which can selectively folded, closed or opened mutually; a foldable cutting mat is mounted in the first page of the substrate and has at least two cutting faces and a fold line disposed between each adjacent cutting face, the folded line is optionally folded between the adjacent cutting faces to reduce the storage area; a detachable ironing mat is arranged at the second page of the substrate in a detachable form and has a core board, a cotton layer covering the outer part of the core board and a cotton cloth surface layer covering the outer part of the cotton layer, wherein at least one ironing surface is formed on the outer part of the cotton cloth surface.

13 Claims, 5 Drawing Sheets

PORTABLE SEWING TOOL KIT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a sewing tool kit product, and more particularly to an innovative portable sewing tool kit.

2. Description of Related Art Including Information Disclosed Under 37 CFR 1.97 and 37 CFR 1.98

The cutting mat and the ironing mat play important roles in sewing. The former is used as the mat for cutting the cloth, paper or leather to avoid cutting the table, and the latter is used as the soft mat for ironing the cloth to achieve a better anti-slippery ironing effect.

For general dress sewing, because the area of material to be processed is large, the area where the cutting mat and ironing mat must be set up is relatively large. However, with the vigorous development of some sewing handicraft teaching industries such as patchwork bags and rag dolls at the market, the demand for related products has increased relatively, and the relevant industry has responded to the needs of users of such sewing crafts for portability, At present, a structure similar to a loose-leaf binder has been developed, and a cutting mat with a small area (such as B5, A4) and an ironing mat are respectively fixed at the left side and right side of the structure similar to the loose-leaf binder in the opened state, so that the cutting mat and ironing mat can be incorporated into a structure similar to the portable loose-leaf binder, thus forming a portable sewing tool kit product type, to achieve the purpose of portability as required.

If according to the conventional configuration of the above portable sewing tool kit, when the industry wants to develop a relatively large area (such as A3) cutting mat to meet the needs of more users, the appearance area of the overall product will be obviously expanded to the same or even larger area accordingly, so that the portability for users will be greatly affected by the doubling of the area.

BRIEF SUMMARY OF THE INVENTION

The present invention mainly aims to provide a portable sewing tool kit, and the technical problem to be solved is how to develop a new portable sewing tool kit structure with portability and larger cutting surface and with more ideal practicability as an innovative breakthrough for the goal.

Based on the foregoing objects, the technical problem to be solved in the present invention is mainly that the mentioned portable cutting tool set includes: a substrate with an inner face and a back face, wherein the inner face is provided with a first page and a second page which can selectively folded, closed or opened mutually for extension, and there is a folded link page between the first page and the second page; a foldable cutting mat is mounted in the first page of the substrate, the foldable cutting mat comprises at least two cutting faces and a fold line disposed between each adjacent cutting face, the folded line is optionally folded between the adjacent cutting faces to reduce the storage area; a detachable ironing mat is arranged at the second page of the substrate in a detachable form and it comprises a core board, a cotton layer covering the outer part of the core board and a cotton cloth surface layer covering the outer part of the cotton layer, wherein at least one ironing surface is formed on the outer part of the cotton cloth surface.

With this innovative and unique design, the present invention can make use of the type characteristics of the foldable cutting mat and the detachable ironing mat stored in a substrate structure as compared with the previous technology, so as to achieve the practical advancement and better industrial utilization efficiency with portability and larger cutting surface.

DETAILED DESCRIPTION OF THE INVENTION

Figure 1:
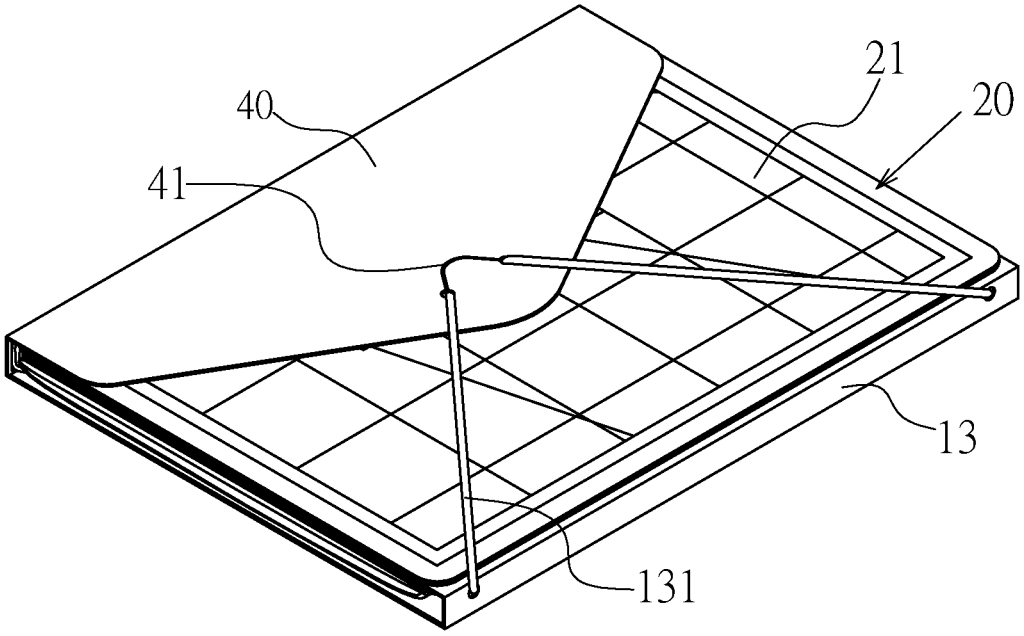
FIG. 1 is a combined three-dimensional diagram of the storage type of the present invention.

Referring to FIGS. 1-6 for better embodiments of the portable sewing tool kit of the present invention, such embodiments are for illustrative purposes only and the patent application is not limited to this structure.

The mentioned portable sewing tool kit comprises the following components: a substrate 10 with an inner face and a back face, wherein the inner face is provided with a first page 11 (indicated only in FIG. 4) and a second page 12 which can selectively folded, closed or opened mutually for extension, and there is a folded link page 13 between the first page 11 and the second page 12; a foldable cutting mat 20 is mounted in the first page 11 of the substrate 10, the foldable cutting mat 20 comprises at least two cutting faces 21 and a fold line 22 disposed between each adjacent cutting face 21, the folded line 22 is optionally folded between the adjacent cutting faces 21 to reduce the storage area; a detachable ironing mat 30 is arranged at the second page 12 of the substrate 10 in a detachable form and it comprises a core board 31, a cotton layer 32 covering the outer part of the core board 31 and a cotton cloth surface layer 33 covering the outer part of the cotton layer 32, wherein at least one ironing surface is formed on the outer part of the cotton cloth surface 33.

Figure 2:
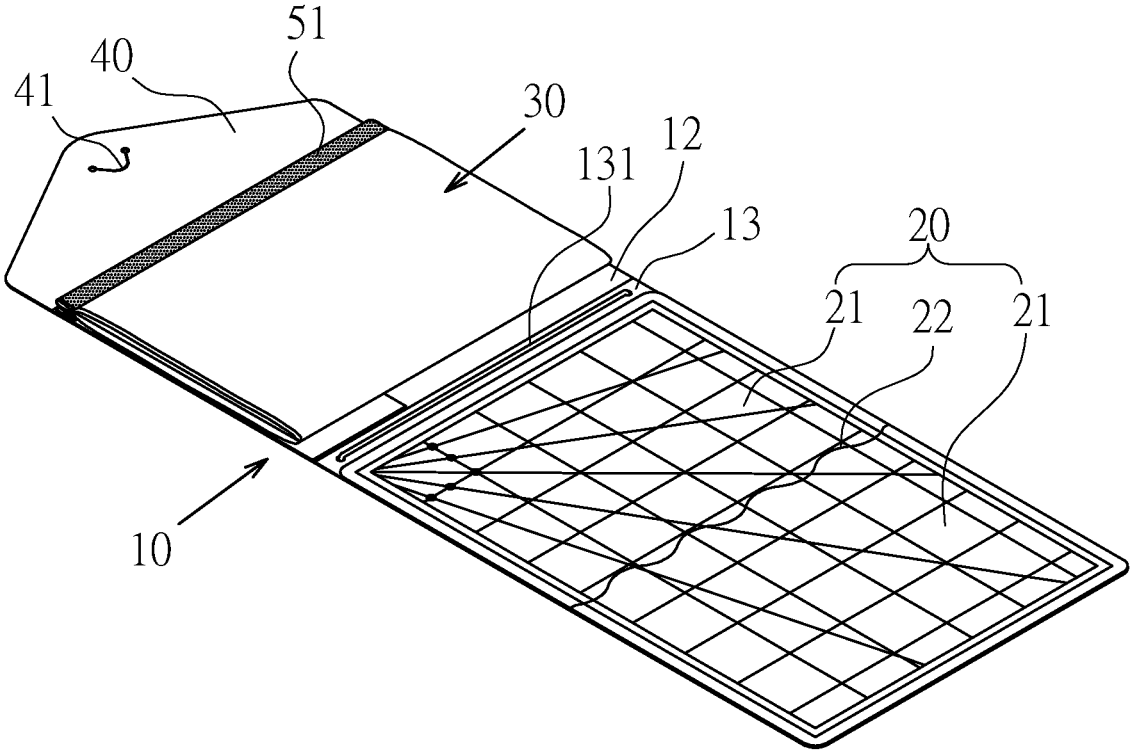
FIG. 2 is a schematic diagram of a better structure embodiment of the present invention.
Figure 9:
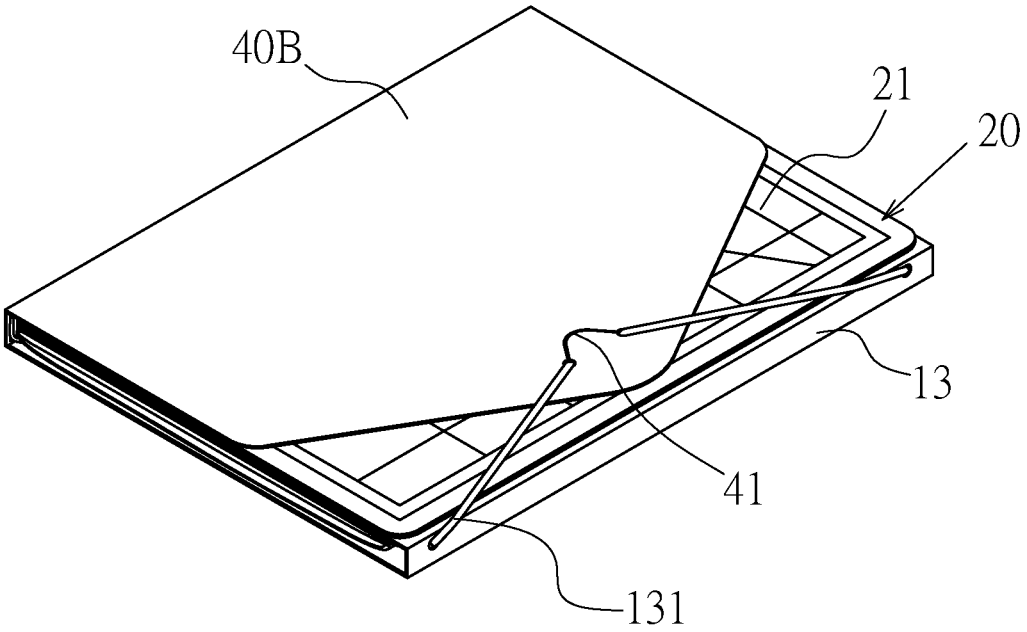
FIG. 9 is a combined three-dimensional diagram of another storage structure variation embodiment of the present invention.

As shown in FIG. 2, in this embodiment, the outer side of the second page 12 of the substrate 10 is further extended to form a foldable panel 40 which can be selectively covered on the foldable cutting mat 20, the foldable panel 40 is provided with a fastening seam 41; the folded link page 13 of the substrate 10 is provided with a spring hook line 131. The elastic hook line 131 can be selectively stretched and hooked in the fastening seam 41 disposed in the foldable panel 40 when the foldable panel 40 is in a closed state, which has a restraining effect at the storage state of the foldable cutting mat 20 and the detachable ironing mat 30. In addition, the foldable panel 40 has a cover area of all the cover or partial cover with respect to the foldable cutting mat 20, and the part is as shown in FIG. 1. The folding panel 40 is in a partially covered type, and the foldable panel 40B as disclosed in FIG. 9 is a nearly fully covered embodiment type; The advantage of this embodiment is that the foldable cutting mat 20 and the detachable ironing mat 30 are preferably in a better stable state, so as to effectively avoid the arbitrary opening of the foldable cutting mat 20 in the process of the portable sewing tool kit carried by the user.

Figure 3:
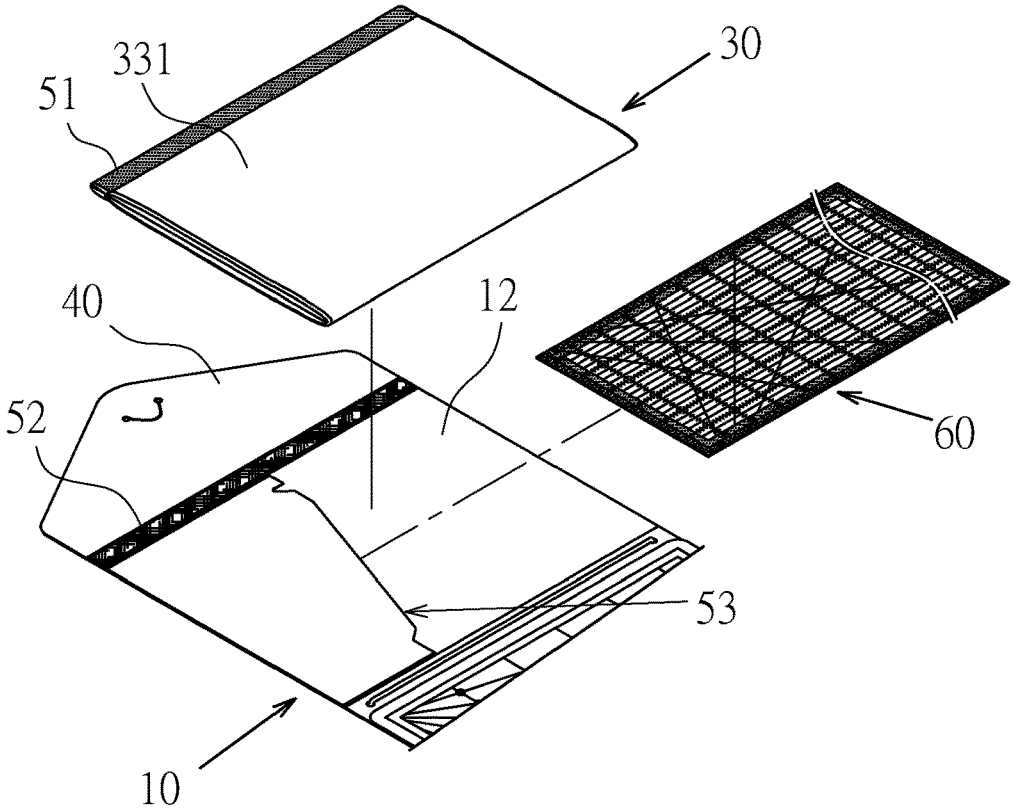
FIG. 3 is a schematic diagram of another better structure embodiment of the present invention.
Figure 4:
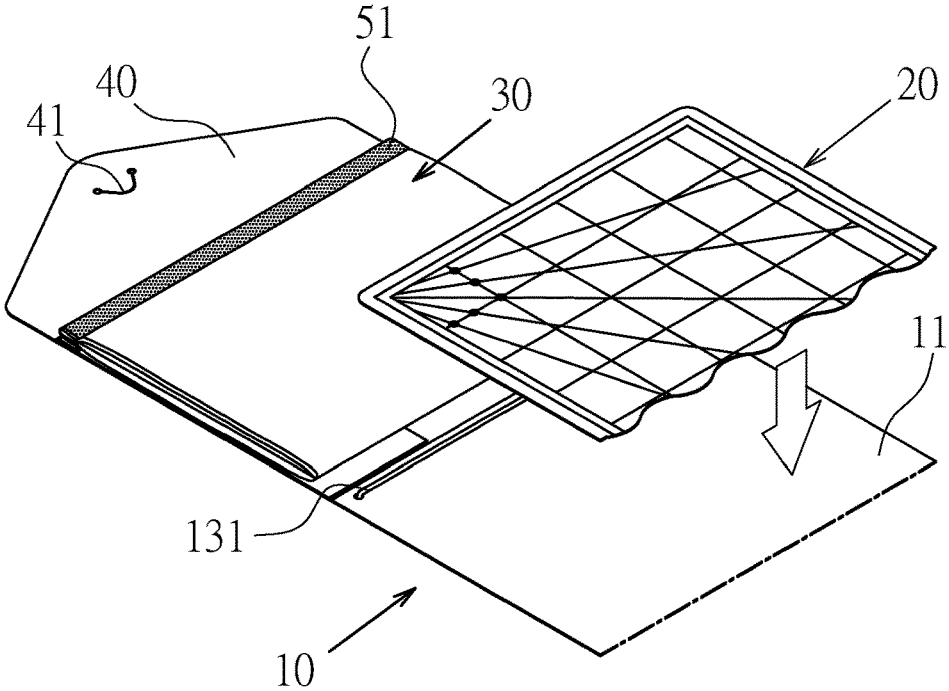
FIG. 4 is a schematic diagram of another better structure embodiment of the present invention.
Figure 5:
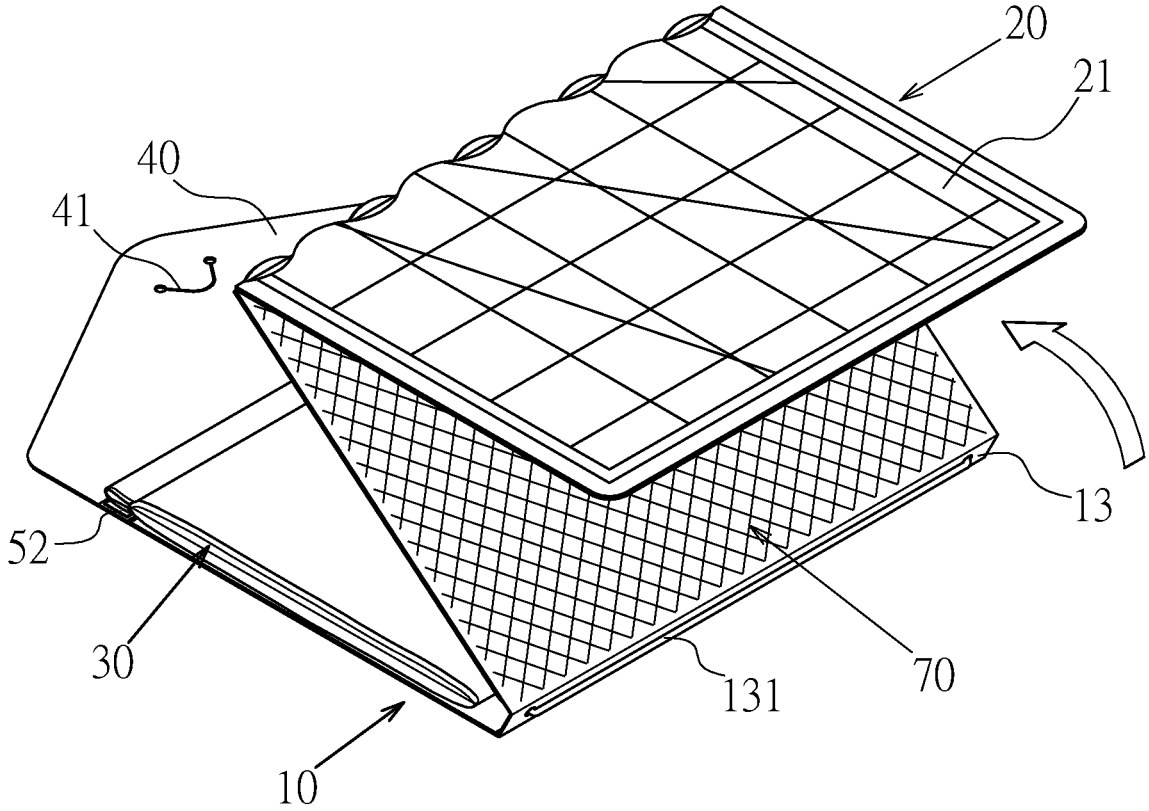
FIG. 5 is a schematic diagram of the foldable storage of the present invention.
Figure 6:
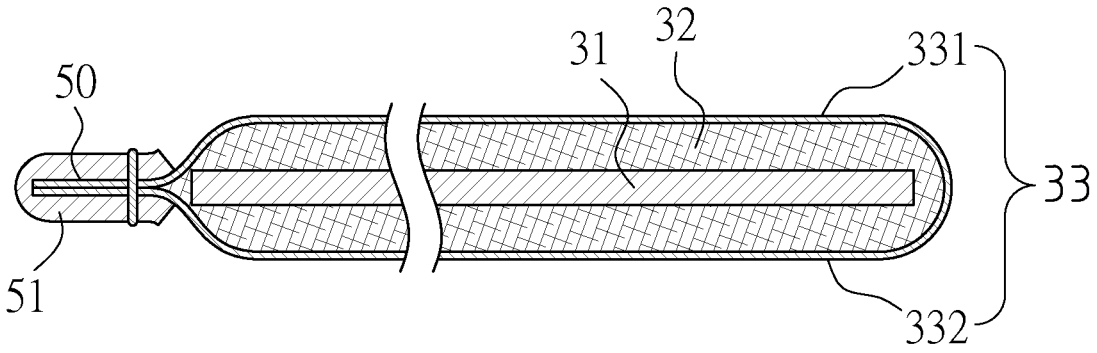
FIG. 6 is a sectional diagram of the detachable ironing mat of the present invention.

As shown in FIGS. 3 and 6, in this embodiment, the outer surface of the cotton cloth surface layer 33 of the detachable ironing mat 30 forms a first ironing surface 331 and a second ironing surface 332 with positive and negative configuration relations. One side of the cotton cloth surface layer 33 has a side strip 50 with a mounting component 51; an additional positioning part 52 is disposed at a side of the second page 12 of the substrate 10, and the mounting component 51 is detachably assembled to the additional positioning part 52. The additional positioning part 52 and the mounting component 51 adopt any of the following detachable combined positioning fittings: male and female adhesive fastening fittings, punching and hole clamp fittings, magnetic fittings or male and female fastening fittings.

Wherein, the core board 31 of the detachable ironing mat 30 is made of the plastic foaming board which is made by foaming any of the following plastic materials: polyvinyl chloride (PVC), polyvinyl alcohol (PVA), polyethylene (PE), polyurethane (PU), ethylene vinyl acetate (EVA) and expandable polyethylene (EPE).

With the above structural composition and technical features, the operation of the present invention will be described as follows: when the portable sewing tool kit of the present invention is to be used, please see FIG. 2, firstly, the foldable cutting mat 20 is opened and expanded, that is, it can be used by the user for cutting work; When the material is to be ironed, the first ironing surface 331 or the second ironing surface 332 of the detachable ironing mat 30 is selected according to the user's ironing habit, in addition, the detachable ironing mat 30 may be used directly in combination with the second page 12 of the substrate 10, or may also be detached and placed in another position for use; when the portable sewing tool kit of the present invention is to be folded after use, please see FIG. 5, if the detachable ironing mat 30 is detached, the detachable ironing mat 30 can be first placed in the positioning part 52, and then the foldable cutting mat 20 is folded to be in a closed state, so that the storage state of the portable sewing tool kit can be easily completed; Since the foldable cutting mat 20 disclosed in the present invention includes at least two cutting faces 21 which are foldable with each other, if the single cutting face 21 is of A4 size, when the two cutting faces 21 are opened in using, the area can be multiplied to the size of the A3, and thus it can be seen that the present invention can achieve the advantages of both portability and larger cutting surface 21, thereby satisfying the diverse needs of related users.

As shown in FIG. 3, the second page 12 of the substrate 10 is further provided with storage interlayer 53 at a position different from the additional positioning portion 52. The storage interlayer 53 can be used by the user to place the sewing ruler 60, the patchwork material and other small tools.

Figure 7:
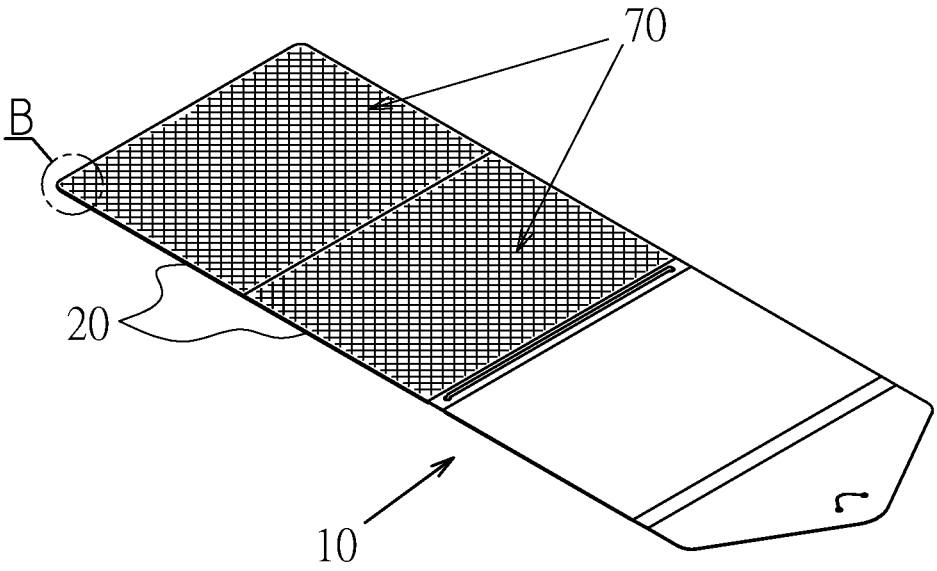
FIG. 7 is a schematic diagram of another structure variation of the present invention.
Figure 8:
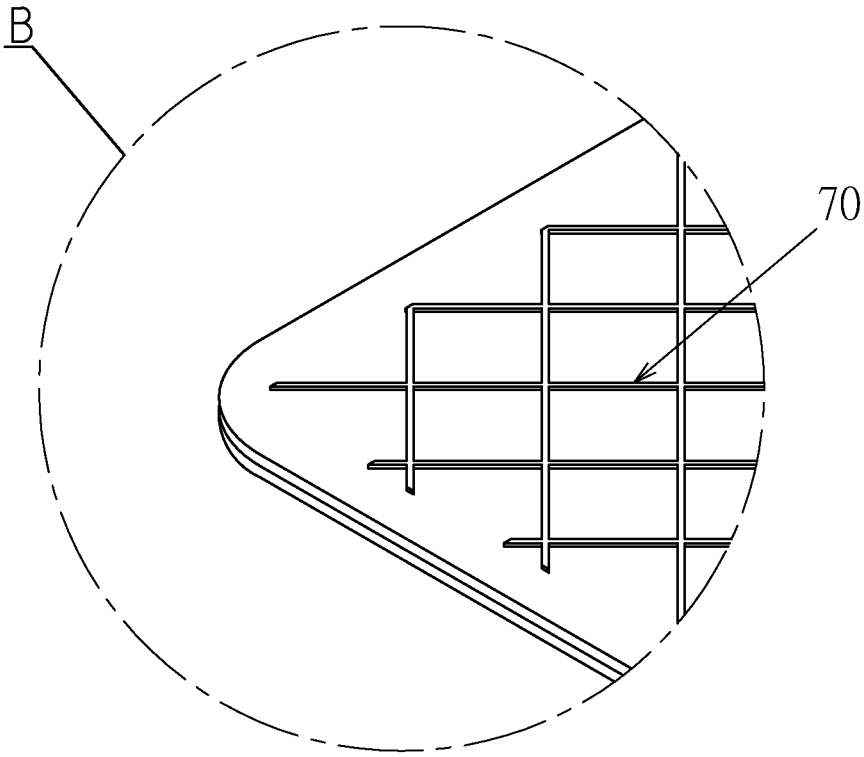
FIG. 8 is an enlarged diagram of Part B in FIG. 7.

As shown in FIGS. 7, 8, in this embodiment, the back face of the substrate 10 is further provided with an ink-printing-forming type anti-slip embossing 70, and the set area range of the ink-printing-forming type anti-slip embossing 70 corresponds to that of the foldable cutting mat 20.

Figure 10:
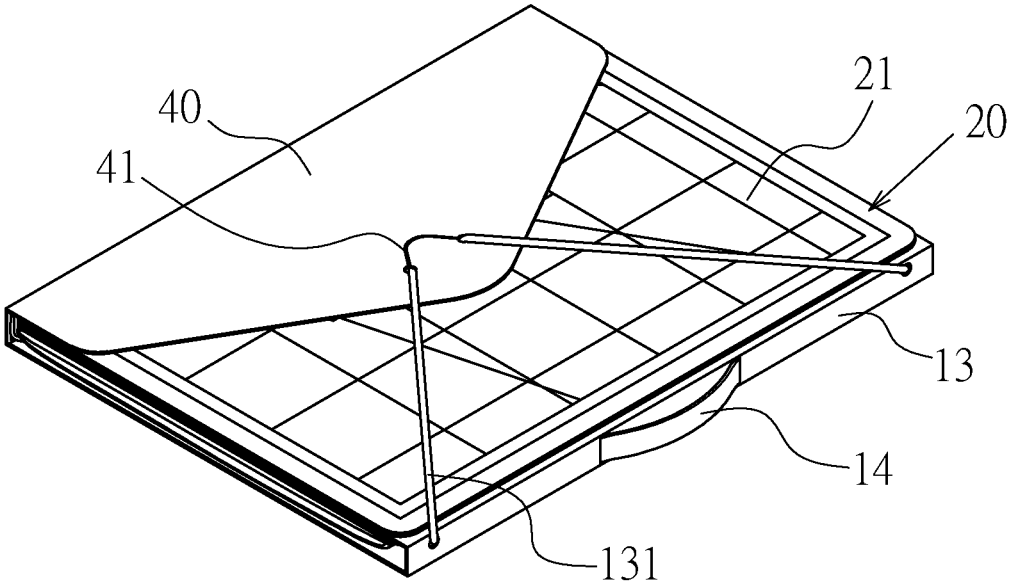
FIG. 10 is a combined three-dimensional diagram of another storage structure variation embodiment of the present invention.

Furthermore, as shown in FIG. 10, in another embodiment of the present invention, the folded link page 13 of the substrate 10 can be provided with a handle 14 which is like a briefcase, so that it can be carried conveniently by hand.

I claim:

1. A portable sewing kit comprising:

a substrate having an inner face and a back face, the inner face having a first page and a second page that are selectively foldable, selectively closable or selectively openable for extension, the first page and the second page having a folded link page therebetween;

a foldable cutting mat mounted in the first page of said substrate, said foldable cutting mat having at least two cutting faces and a fold line disposed between adjacent cutting faces of the at least two cutting faces, the fold line being foldable; and a detachable ironing mat detachably arranged at the second page of said substrate, said detachable ironing mat having a core board and a cotton layer covering an outer part of the core board and a cotton cloth surface covering an outer part of the cotton layer, wherein at least one ironing surface is formed on an outer part of the cotton cloth surface.

2. The portable sewing tool kit of claim 1, wherein an outer side of the second page is extendable, the foldable panel having a fastening seam, the foldable link page having an elastic hook line that can selectively stretched and hooked in the fastening seam when the foldable panel is closed.

3. The portable sewing tool kit of claim 2, wherein the foldable panel at least partially covers said foldable cutting mat.

4. The portable sewing tool kit of claim 3, wherein an outer surface of the cotton cloth surface defines a first ironing surface and a second ironing surface.

5. The portable sewing tool kit of claim 4, wherein one side of the cotton cloth surface has a side strip with a mounting component, wherein a positioning part is disposed at the outer side of the second page of said substrate, the mounting component being detachably assembled onto the positioning part, the positioning part and the mounting component being male and female adhesive fittings.

6. The portable sewing tool kit of claim 5, wherein the core board is formed of a foamed plastic material selected from the group consisting of polyvinyl chloride, polyvinyl alcohol, polyethylene, polyurethane, ethylene vinyl acetate and expandable polyethylene.

7. The portable sewing tool kit of claim 6, wherein the second page of said substrate has a storage interlayer at a position away from the positioning part.

8. The portable sewing tool kit of claim 7, wherein the folded link page of said substrate has a handle.

9. The portable sewing tool kit of claim 8, wherein the back face of said substrate has an anti-slip embossing corresponding in area to said foldable cutting mat.

10. The portable sewing tool kit of claim 4, wherein one side of the cotton cloth surface has a side strip with a mounting component, wherein a positioning part is disposed at the outer side of the second page of said substrate, the mounting component being detachably assembled onto the positioning part, the positioning part and the mounting component being punching and hole clamp fittings.

11. The portable sewing tool kit of claim 4, wherein one side of the cotton cloth surface has a side strip with a mounting component, wherein a positioning part is disposed at the outer side of the second page of said substrate, the mounting component being detachably assembled onto the positioning part, the positioning part and the mounting component being magnetic fittings.

12. The portable sewing tool kit of claim 4, wherein one side of the cotton cloth surface has a side strip with a mounting component, wherein a positioning part is disposed at the outer side of the second page of said substrate, the mounting component being detachably assembled onto the positioning part, the positioning part and the mounting component being male and female fastening fittings.

13. The portable sewing tool kit of claim 2, wherein the foldable panel entirely covers said foldable cutting mat.

* * * * *